US011158282B2

(12) United States Patent
Huang

(10) Patent No.: US 11,158,282 B2
(45) **Date of Patent: *Oct. 26, 2021**

(54) DRIVING CIRCUIT OF DISPLAY PANEL, AND DISPLAY DEVICE

(71) Applicant: HKC Corporation Limited, Shenzhen (CN)

(72) Inventor: Xiaoyu Huang, Shenzhen (CN)

(73) Assignee: HKC Corporation Limited, Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/043,934

(22) PCT Filed: Nov. 23, 2018

(86) PCT No.: PCT/CN2018/117237
§ 371 (c)(1),
(2) Date: Sep. 30, 2020

(87) PCT Pub. No.: WO2020/097970
PCT Pub. Date: May 22, 2020

(65) Prior Publication Data

US 2021/0118399 A1 Apr. 22, 2021

(30) Foreign Application Priority Data

Nov. 12, 2018 (CN) ..... 201811339279.0

(51) Int. Cl.
*G09G 3/36* (2006.01)

(52) U.S. Cl.
CPC ..... *G09G 3/3696* (2013.01); *G09G 3/36* (2013.01); *G09G 3/3648* (2013.01);
(Continued)

(58) Field of Classification Search
CPC ..... G09G 2320/043; G09G 2310/061; G09G 2310/0248; G09G 2310/0251;
(Continued)

(56) References Cited

U.S. PATENT DOCUMENTS 6,271,812 B1 * 8/2001 Osada ..... G09G 3/30 315/169.1
7,602,364 B2 * 10/2009 Shih ..... G09G 3/3648 345/211
(Continued)

FOREIGN PATENT DOCUMENTS

CN 107731186 A 2/2018
CN 108231030 A 6/2018
(Continued)

OTHER PUBLICATIONS

English Translation of the International Search Report dated Aug. 15, 2019, issued in corresponding International Application No. PCT/CN2018/117237, filed Nov. 23, 2018, 2 pages.
(Continued)

*Primary Examiner* — Michael J Jansen, II
(74) *Attorney, Agent, or Firm* — Christensen O'Connor Johnson Kindness PLLC

(57) ABSTRACT

A driving circuit of a display panel includes a trigger circuit, a current limiting circuit, and first and second switch circuits. A preset voltage and a first voltage are input the trigger circuit. The current limiting circuit is electrically connected to a power source. The first switch circuit is electrically connected to the trigger circuit and the current limiting circuit separately. The first switch circuit is electrically connected to a driving chip and the display panel (320). The second switch circuit (400) is electrically connected to the trigger circuit and the current limiting circuit separately. An
(Continued)

output terminal of the second switch circuit is electrically connected to the display panel.

20 Claims, 2 Drawing Sheets

(52) U.S. Cl.
CPC ..... *G09G 2310/0245* (2013.01); *G09G 2310/0264* (2013.01); *G09G 2310/061* (2013.01); *G09G 2320/0257* (2013.01); *G09G 2330/027* (2013.01)

(58) Field of Classification Search
CPC ..... G09G 2310/063; G09G 2330/026; G09G 2330/027; G09G 2330/02; G09G 2320/0257; G09G 3/36; G09G 3/3696; G09G 3/3648; G09G 2310/0245; G09G 2310/0264; G09G 2320/0257; G09G 2330/021; H03K 17/0822
See application file for complete search history.

(56) References Cited

U.S. PATENT DOCUMENTS 8,040,309 B2 * 10/2011 Hung ..... G09G 3/3696 345/92
8,625,039 B2 * 1/2014 Tajiri ..... G09G 3/3677 349/42
8,711,137 B2 * 4/2014 Fang ..... G09G 3/3648 345/212
8,803,440 B2 * 8/2014 Cao ..... G09G 3/3406 315/291
9,159,267 B2 * 10/2015 Tajiri ..... G09G 3/3258
9,541,981 B2 * 1/2017 Shirakami ..... G09G 3/3696
10,438,546 B2 * 10/2019 Yang ..... G09G 3/20
10,510,316 B2 * 12/2019 Xiong ..... G05F 1/565
10,629,129 B2 * 4/2020 Xiao ..... G09G 3/3614
10,714,045 B2 * 7/2020 Sun ..... G09G 3/3696
10,747,075 B2 * 8/2020 Li ..... G02F 1/136204
10,885,864 B2 * 1/2021 Huang ..... G09G 3/3266
2002/0196223 A1 * 12/2002 Takahashi ..... G09G 3/367 345/90
2005/0099376 A1 * 5/2005 Shih ..... G09G 3/3648 345/98
2007/0176866 A1 * 8/2007 Hung ..... G09G 3/3696 345/87
2007/0182670 A1 * 8/2007 Watanabe ..... G09G 3/22 345/75.2
2009/0097180 A1 * 4/2009 Feng ..... H05B 41/2855 361/91.1
2010/0097365 A1 * 4/2010 Fang ..... G09G 3/3696 345/212
2011/0075063 A1 * 3/2011 Tajiri ..... G09G 3/3258 349/42
2013/0241416 A1 * 9/2013 Toth ..... H05B 45/56 315/127
2014/0092074 A1 * 4/2014 Tajiri ..... G09G 3/3677 345/211
2014/0176855 A1 * 6/2014 Cao ..... G09G 3/3406 349/61
2015/0309550 A1 * 10/2015 Shirakami ..... G06F 1/30 713/300
2017/0206851 A1 * 7/2017 Sun ..... G09G 3/2092
2017/0345372 A1 * 11/2017 Xiao ..... G09G 3/3266
2018/0240414 A1 * 8/2018 Yang ..... G09G 3/36
2019/0130865 A1 * 5/2019 Xiong ..... G05F 1/62
2019/0221183 A1 * 7/2019 Hou ..... G09G 3/3696
2019/0235326 A1 * 8/2019 Li ..... G09G 3/3648
2020/0135131 A1 * 4/2020 Huang ..... G09G 3/3696
2020/0372871 A1 * 11/2020 Chen ..... G09G 3/3648
2021/0027690 A1 * 1/2021 Ji ..... G09G 3/20
2021/0035510 A1 * 2/2021 Huang ..... G09G 3/36

FOREIGN PATENT DOCUMENTS

KR 20140086218 A 7/2014
TW 567456 B 12/2003

OTHER PUBLICATIONS

First Chinese Office Action dated Oct. 11, 2019, issued in corresponding CN Application No. 201811339279.0, filed Nov. 12, 2018, 8 pages.

* cited by examiner

DRIVING CIRCUIT OF DISPLAY PANEL, AND DISPLAY DEVICE

TECHNICAL FIELD

The present disclosure relates to the field of liquid crystal display technologies, and more particularly relates to a drive circuit for a display panel and a display device.

BACKGROUND

The description herein provides only background information related to the present disclosure but does not necessarily constitute the existing technology.

A thin film transistor liquid crystal display (TFT-LCD) is one of main varieties of present flat-panel displays and has become an important display platform for modern information technology (IT) and video products.

A main drive principle for a TFT-LCD is as follows: A system board connects a red/green/blue (R/G/B) compression signal (a tricolor signal), a control signal, and power to a connector on a printed circuit board (PCB) through a wire; data is processed by a timing controller (TCON) integrated circuit (IC) on the PCB, passes through the PCB and is connected to a display area through a source-chip on film (S-COF) and a gate-chip on film (G-COF); and therefore, the LCD obtains required power and signals.

In recent years, gate on array (GOA) technologies have been rapidly developed in order to meet requirements on ultra-narrow frame and cost reduction.

During actual operation, in order to resolve the problems of power-off afterimage and the like, a G-COF in a conventional architecture is integrated with an output all on (XAO) function. That is, in an off state, gate turning-on signals are output by all output of the G-COF to turn on all TFTs in a display panel and neutralize charges in pixel electrodes, thereby avoiding the power-off afterimage caused by residual charges after power-off. Since its gate drive chip is integrated into an array substrate, it is impossible for a GOA technology to resolve the problem of power-off afterimage.

SUMMARY

In view of this, the present disclosure discloses a drive circuit for a display panel and a display device, so as to resolve the problem of power-off afterimage in a GOA (Gate On Array) architecture, improve product quality, and enhance competitiveness of the product.

A drive circuit for a display panel includes:

a trigger circuit, a preset voltage is input through a first input end of the trigger circuit, and a first voltage is input through a second input end of the trigger circuit;

a current limiting circuit, an input end of the current limiting circuit is electrically coupled to an output end of a power supply;

a first switching circuit, a first input end of the first switching circuit is electrically coupled to an output end of the trigger circuit and an output end of the current limiting circuit, respectively; a second input end of the first switching circuit is electrically coupled to an output end of a drive chip, and an output end of the first switching circuit is electrically coupled to the display panel; and a second switching circuit, a first input end of the second switching circuit is electrically coupled to the output end of the trigger circuit and the output end of the current limiting circuit, respectively; a second input end of the second switching circuit is electrically coupled to the first input end of the trigger circuit, and an output end of the second switching circuit is electrically coupled to the display panel;

when the first switching circuit is switched on, the second switching circuit is switched off, and when the second switching circuit is switched on, the first switching circuit is switched off.

In one of the embodiments, the trigger circuit includes:

a trigger, the first voltage is input through a pulse input end of the trigger, the preset voltage is input through a D input end of the trigger, and a Q output end of the trigger is electrically coupled to the first input end of the first switching circuit and the first input end of the second switching circuit, respectively.

In one of the embodiments, the current limiting circuit includes:

a first resistor, one end of the first resistor is electrically coupled to the output end of the power supply, and the other end of the first resistor is electrically coupled to the first input end of the first switching circuit and the first input end of the second switching circuit, respectively.

In one of the embodiments, the first switching circuit includes:

a first switching transistor, a gate of the first switching transistor is electrically coupled to the output end of the trigger circuit and the output end of the current limiting circuit, respectively; a source of the first switching transistor is electrically coupled to the output end of the drive chip, and a drain of the first switching transistor is electrically coupled to the display panel; or the source of the first switching transistor is electrically coupled to the display panel, and the drain of the first switching transistor is electrically coupled to the output end of the drive chip.

In one of the embodiments, the second switching circuit includes:

a second switching transistor, a gate of the second switching transistor is electrically coupled to the output end of the trigger circuit and the output end of the current limiting circuit, respectively; a source of the second switching transistor is electrically coupled to the first input end of the trigger circuit, and a drain of the second switching transistor is electrically coupled to the display panel; or the source of the second switching transistor is electrically coupled to the display panel, and the drain of the second switching transistor is electrically coupled to the first input end of the trigger circuit.

In one of the embodiments, the drive circuit further includes:

a step-down circuit, electrically coupled between the first input end of the trigger circuit and the first input end of the second switching circuit.

In one of the embodiments, the step-down circuit includes:

a second resistor, one end of the second resistor is electrically coupled to the first input end of the trigger circuit, and the other end of the second resistor is electrically coupled to the first input end of the second switching circuit.

A drive circuit for a display panel includes:

a trigger, a preset voltage is input through a first input end of the trigger, and a first voltage is input through a second input end of the trigger;

a current limiting circuit, an input end of the current limiting circuit is electrically coupled to an output end of a power supply;

a first switching transistor, a first input end of the first switching transistor is electrically coupled to an output end of the trigger and an output end of the current limiting circuit, respectively; a second input end of the first switching transistor is electrically coupled to an output end of a drive chip, and an output end of the first switching transistor is electrically coupled to the display panel; and a second switching transistor, a first input end of the second switching transistor is electrically coupled to the output end of the trigger and the output end of the current limiting circuit, respectively; a second input end of the second switching transistor is electrically coupled to the first input end of the trigger, and an output end of the second switching transistor is electrically coupled to the display panel;

when the first switching transistor is switched on, the second switching transistor is switched off, and when the second switching transistor is switched on, the first switching transistor is switched off.

A display device includes:

a display panel; and the drive circuit of any of the aforementioned embodiments.

In one of the embodiments, the display device further includes:

a housing, the drive circuit being arranged in the housing.

According to the present disclosure, the trigger circuit, the current limiting circuit, the first switching circuit, and the second switching circuit are matched, and the first switching circuit and the second switching circuit are controlled through the trigger circuit to be switched on and switched off, so that the problem of power-off afterimage under a GOA architecture can be resolved, the product quality can be improved, and competitiveness of the product is further enhanced.

DESCRIPTION OF THE DRAWINGS

To describe the technical solutions in the embodiments of the present disclosure or in the prior art more clearly, the following briefly introduces the accompanying drawings required for describing the embodiments or the prior art. The accompanying drawings in the following description show merely the embodiments of the present disclosure, and a person of ordinary skill in the art may still derive other drawings from these accompanying drawings without creative efforts.

REFERENCE NUMERALS

Figure 1:
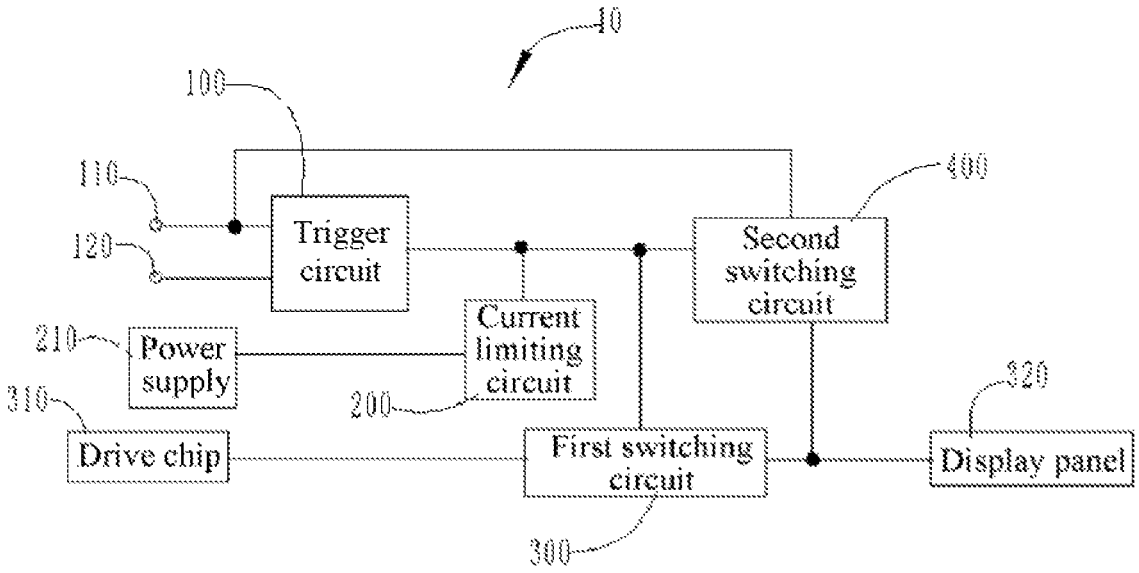
FIG. 1 is a block diagram of a drive circuit for a display panel according to an embodiment of the present disclosure.

10 drive circuit for display panel
100 trigger circuit
110 preset voltage
120 first voltage
130 trigger
20 display device
200 current limiting circuit
210 power supply
220 first resistor
300 first switching circuit
310 drive chip
320 display panel
330 first switching transistor
331 first field effect transistor
400 second switching circuit
410 second switching transistor
411 second field effect transistor
500 step-down circuit
510 second resistor
600 housing

DETAILED DESCRIPTION

The following clearly and completely describes the technical solutions in the embodiments of the present disclosure with reference to the accompanying drawings in the embodiments of the present disclosure. Apparently, the described embodiments are some embodiments of the present disclosure rather than all of the embodiments. All other embodiments obtained by a person of ordinary skill in the art based on the embodiments of the present disclosure without creative efforts shall fall within the protection scope of the present disclosure.

Embodiments of the present disclosure disclose a drive circuit for a display panel and a display device, so as to resolve the problem of power-off afterimage in a GOA (Gate On Array) architecture, improve product quality, and enhance competitiveness of the product.

Referring to FIG. 1, an embodiment of the present disclosure provides a drive circuit 10 for a display panel, including a trigger circuit 100, a current limiting circuit 200, a first switching circuit 300, and a second switching circuit 400. A preset voltage 110 is input through a first input end of the trigger circuit 100. A first voltage 120 is input through a second input end of the trigger circuit 100. An input end of the current limiting circuit 200 is electrically coupled to an output end of a power supply 210. A first input end of the first switching circuit 300 is electrically coupled to an output end of the trigger circuit 100 and an output end of the current limiting circuit 200, respectively. A second input end of the first switching circuit 300 is electrically coupled to an output end of a drive chip 310. An output end of the first switching circuit 300 is electrically coupled to the display panel 320.

A first input end of the second switching circuit 400 is electrically coupled to the output end of the trigger circuit 100 and the output end of the current limiting circuit 200, respectively. A second input end of the second switching circuit 400 is electrically coupled to the first input end of the trigger circuit 100. An output end of the second switching circuit 400 is electrically coupled to the display panel 320. When the first switching circuit 300 is switched on, the second switching circuit 400 is switched off. When the second switching circuit 400 is switched on, the first switching circuit 300 is switched off.

A preset voltage 110 is input through a first input end of the trigger circuit 100. It can be understood that a specific numerical value of the preset voltage 110 is not limited as long as all TFTs in the display panel 320 are turned on. In an embodiment, the numerical value of the preset voltage 110 may be 25V. In an embodiment, the numerical value of the preset voltage 110 may be 33V. The specific numerical value of the preset voltage 110 may be selected according to a practical requirement. A first voltage 120 is input through a second input end of the trigger circuit 100. The first voltage 120 is an input voltage of the display panel 320. Similarly, a specific numerical value of the first voltage 120 is also not specifically limited. In an embodiment, the first voltage 120 may be set to 12V or 14V.

It can be understood that a specific structure of the trigger circuit 110 may not be specifically limited as long as the first switching circuit 300 and the second switching circuit 400 may be controlled to be switched on and switched off on the basis of the preset voltage 110 and the first voltage 120. In an embodiment, the trigger circuit 100 may consist of a D trigger. When the D trigger outputs a high level on the basis of the preset voltage 110 and the first voltage 120, the second switching circuit 400 is switched on, and the first switching circuit 300 is switched off. When the D trigger outputs a low level on the basis of the preset voltage 110 and the first voltage 120, the second switching circuit 400 is switched off, and the first switching circuit 300 is switched on.

It can be understood that a specific structure of the current limiting circuit 200 may not be specifically limited as long as safety of the drive circuit 10 is ensured. In an embodiment, the current limiting circuit 200 may consist of a resistor with fixed resistance. In an embodiment, the current limiting circuit 200 may consist of a sliding rheostat. The specific structure may be selected according to a practical requirement.

The first switching circuit 300 receives a control signal of the trigger circuit 100. When the control signal is a low level, the first switching circuit 300 is in an on state. When the control signal is a high level, the first switching circuit 300 is in an off state. A specific structure of the first switching circuit 300 may not be specifically limited as long as a function of switching according to the control signal output by the trigger circuit 100 may be ensured. In an embodiment, the first switching circuit 300 is a relay control switch. In an embodiment, the first switching circuit 300 is a switching transistor control switch.

The second switching circuit 400 receives the control signal of the trigger circuit 100. When the control signal is a low level, the second switching circuit 400 is in the off state. When the control signal is a high level, the second switching circuit 400 is in the on state. A specific structure of the second switching circuit 400 may not be specifically limited as long as the function of switching according to the control signal output by the trigger circuit 100 may be ensured. In an embodiment, the second switching circuit 400 is a relay control switch. In an embodiment, the second switching circuit 400 is a switching transistor control switch.

In the embodiment, the trigger circuit 100, the current limiting circuit 200, the first switching circuit 300 and the second switching circuit 400 are matched. The first switching circuit 300 and the second switching circuit 400 are controlled through the trigger circuit 100 to be switched on and switched off. Therefore, the problem of power-off afterimage under a GOA architecture can be resolved, quality of a product can be improved, and competitiveness of the product is further improved.

Figure 2:
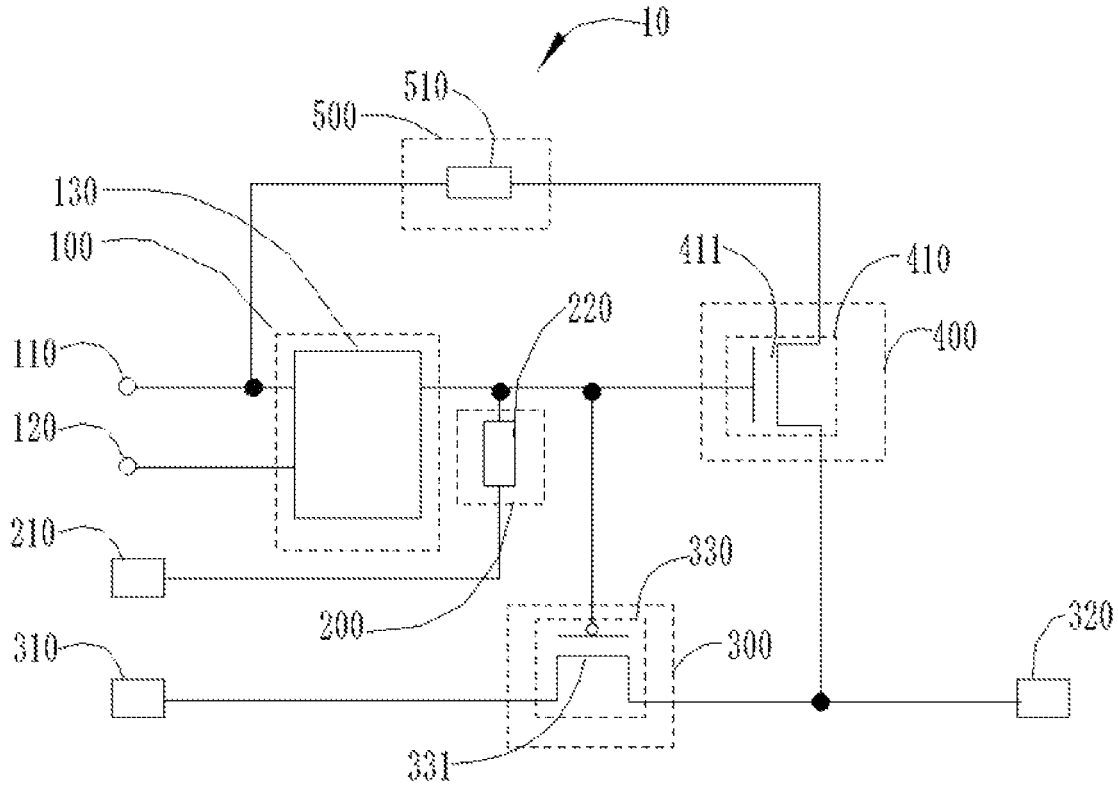
FIG. 2 is a schematic circuit diagram of a drive circuit for a display panel according to an embodiment of the present disclosure.

Referring to FIG. 2, in an embodiment, the trigger circuit 100 includes a trigger 130. The first voltage 120 is input through a pulse input end of the trigger 130. The preset voltage 110 is input through a D input end of the trigger 130. A Q output end of the trigger 130 is electrically coupled to the first input end of the first switching circuit 300 and the first input end of the second switching circuit 400, respectively.

The trigger 130 may use a falling edge D trigger. Specifically, when the pulse input end of the trigger receives a falling edge control signal, the Q output end of the trigger outputs a voltage of the D end of the trigger (that is, a high level). When the pulse input end of the trigger receives a rising edge control signal, the Q output end of the trigger does not output any trigger signal (that is, does not change running states of the first switching circuit 300 and the second switching circuit 400 at this point).

In an embodiment, the current limiting circuit 200 includes a first resistor 220. One end of the first resistor 220 is electrically coupled to the output end of the power supply 210. The other end of the first resistor 220 is electrically coupled to the first input end of the first switching circuit 300 and the first input end of the second switching circuit 400, respectively. It can be understood that a specific structure of the first resistor 220 may not be specifically limited as long as a current limiting function may be achieved. In an embodiment, the first resistor 220 is a sliding rheostat with variable resistance. In an embodiment, the first resistor 220 is a resistor with fixed resistance.

In an embodiment, the first switching circuit 300 includes a first switching transistor 330. A gate of the first switching transistor 330 is electrically coupled to the output end of the trigger circuit 100 and the output end of the current limiting circuit 200, respectively. A source of the first switching transistor 330 is electrically coupled to the output end of the drive chip 310, and a drain of the first switching transistor 330 is electrically coupled to the display panel 320. Alternatively, the source of the first switching transistor 330 is electrically coupled to the display panel, and the drain of the first switching transistor 330 is electrically coupled to the output end of the drive chip 310.

It can be understood that, when the source of the first switching transistor 330 is electrically coupled to the output end of the drive chip 310, the drain of the first switching transistor 330 is electrically coupled to the display panel 320. When the drain of the first switching transistor 330 is electrically coupled to the output end of the drive chip 310, the source of the first switching transistor 330 is electrically coupled to the display panel 320. That is, the drain and source of the first switching transistor 330 may be selected according to a practical requirement and a position relationship therebetween is not specifically limited. The first switching transistor 330 may use a first MOS (metal oxide silicon) transistor (field effect transistor) 331. In an embodiment, the first switching transistor 330 may use an N-channel MOS transistor. In an embodiment, the first switching transistor 330 may also use a P-channel MOS transistor. A specific structure may be selected according to a practical requirement.

In an embodiment, the second switching circuit 400 includes a second switching transistor 410. A gate of the second switching transistor 410 is electrically coupled to the output end of the trigger circuit 100 and the output end of the current limiting circuit 200, respectively. A source of the second switching transistor 410 is electrically coupled to the first input end of the trigger circuit 100, and a drain of the second switching transistor 410 is electrically coupled to the display panel 320. Alternatively, the source of the second switching transistor 410 is electrically coupled to the display panel 320, and the drain of the second switching transistor 410 is electrically coupled to the first input end of the trigger circuit 100.

It can be understood that, when the source of the second switching transistor 410 is electrically coupled to the first input end of the trigger circuit 100, the drain of the second switching transistor 410 is electrically coupled to the display panel 320. When the drain of the second switching transistor 410 is electrically coupled to the first input end of the trigger circuit 100, the source of the second switching transistor 410 is electrically coupled to the display panel 320. That is, the drain and source of the second switching transistor 410 may be selected according to a practical requirement and a position relationship therebetween is not specifically limited.

In an embodiment, the second switching transistor 410 may use a second MOS transistor (field effect transistor) 411. In an embodiment, the second switching transistor 410 may use an N-channel MOS transistor. In an embodiment, the second switching transistor 410 may also use a P-channel MOS transistor. A specific structure may be selected according to a practical requirement. In an embodiment, the second switching transistor 410 uses a P-channel MOS transistor, and the first switching transistor 330 uses an N-channel MOS transistor. In an embodiment, the second switching transistor 410 uses an N-channel MOS transistor, and the first switching transistor 330 uses a P-channel MOS transistor.

In an embodiment, the drive circuit 10 further includes a step-down circuit 500. The step-down circuit 500 is electrically coupled between the first input end of the trigger circuit 100 and the first input end of the second switching circuit 400. It can be understood that a specific structure of the step-down circuit 500 may not be specifically limited as long as the safety of the drive circuit 10 is ensured. In an embodiment, the step-down circuit 500 may consist of a resistor with fixed resistance. In an embodiment, the step-down circuit 500 may consist of a sliding rheostat with variable resistance. A specific structure of the step-down circuit 500 may be selected according to a practical requirement.

In an embodiment, the step-down circuit 500 includes a second resistor 510. One end of the second resistor 510 is electrically coupled to the first input end of the trigger circuit 100. The other end of the second resistor 510 is electrically coupled to the first input end of the second switching circuit 400. It can be understood that a specific structure of the second resistor 510 may not be specifically limited as long as the current limiting function may be achieved. In an embodiment, the second resistor 510 is a sliding rheostat with variable resistance. In an embodiment, the second resistor 510 is a resistor with fixed resistance.

Figure 3:
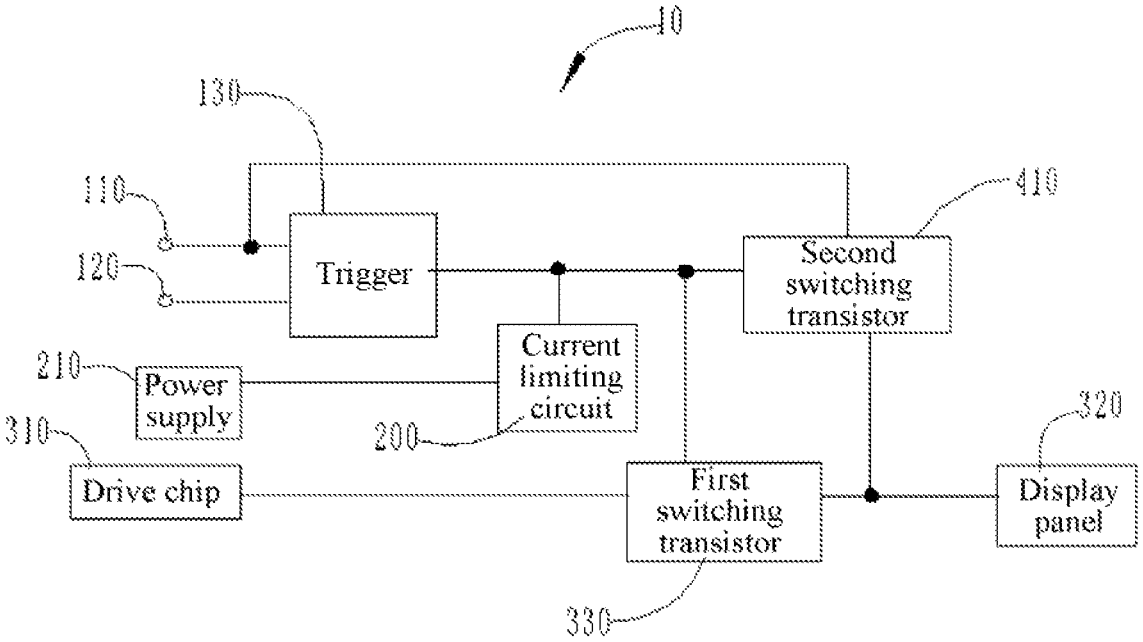
FIG. 3 is a block diagram of a drive circuit for a display panel according to another embodiment of the present disclosure.

Referring to FIG. 3, an embodiment of the present disclosure provides a drive circuit for a display panel, including a trigger 130, a current limiting circuit 200, a first switching transistor 330 and a second switching transistor 410. A preset voltage 110 is input through a first input end of the trigger 130. A first voltage 120 is input through a second input end of the trigger 130. An input end of the current limiting circuit 200 is electrically coupled to an output end of a power supply 210. A first input end of the first switching transistor 330 is electrically coupled to an output end of the trigger 130 and an output end of the current limiting circuit 200, respectively. A second input end of the first switching transistor 330 is electrically coupled to an output end of a drive chip 310. An output end of the first switching transistor 330 is electrically coupled to the display panel 320.

A first input end of the second switching transistor 410 is electrically coupled to the output end of the trigger 130 and the output end of the current limiting circuit 200, respectively. A second input end of the second switching transistor 410 is electrically coupled to the first input end of the trigger 130. An output end of the second switching transistor 410 is electrically coupled to the display panel 320. When the first switching transistor 330 is switched on, the second switching transistor 410 is switched off, and when the second switching transistor 410 is switched on, the first switching transistor 330 is switched off.

It can be understood that a specific numerical value of the preset voltage 110 is not limited as long as all TFTs in the display panel 320 are turned on. In an embodiment, the numerical value of the preset voltage 110 may be 25V. In an embodiment, the numerical value of the preset voltage 110 may be 33V. The specific numerical value of the preset voltage 110 may be selected according to a practical requirement. The first voltage 120 is input through the second input end of the trigger circuit 100. The first voltage 120 refers to an input voltage of the display panel 320. Similarly, a specific numerical value of the first voltage 120 is also not specifically limited. In an embodiment, the first voltage 120 may be set to 12V or 14V.

The trigger 130 may use a falling edge D trigger. Specifically, when a pulse input end of the trigger receives a falling edge control signal, a Q output end of the trigger outputs a voltage of a D end of the trigger (that is, a high level). When the pulse input end of the trigger receives a rising edge control signal, the Q output end of the trigger does not output any trigger signal (that is, does not change running states of the first switching circuit 300 and the second switching circuit 400 at this point).

It can be understood that a specific structure of the current limiting circuit 200 may not be specifically limited as long as safety of the drive circuit 10 is ensured. In an embodiment, the current limiting circuit 200 may consist of a resistor with fixed resistance. In an embodiment, the current limiting circuit 200 may consist of a sliding rheostat. A specific structure may be selected according to a practical requirement.

The first switching transistor 330 receives a control signal of the trigger 130. When the control signal is a low level, the first switching transistor 330 is in an on state. When the control signal is a high level, the first switching transistor 330 is in an off state. A specific structure of the first switching transistor 330 may not be specifically limited as long as a function of switching according to the control signal output by the trigger 130 may be ensured. In an embodiment, the first switching transistor 330 is a relay control switch. In an embodiment, the first switching transistor 330 is an MOS transistor switch.

The second switching transistor 410 receives the control signal of the trigger 130. When the control signal is a high level, the second switching transistor 410 is in the off state. When the control signal is a low level, the second switching transistor 410 is in the on state. A specific structure of the second switching transistor 410 may not be specifically limited as long as the function of switching according to the control signal output by the trigger 130 may be ensured. In an embodiment, the second switching transistor 410 is a relay control switch. In an embodiment, the second switching transistor 410 is an MOS transistor switch.

In the embodiment, the trigger 130, the current limiting circuit 200, the first switching transistor 330 and the second switching transistor 410 are matched. The first switching transistor 330 and the second switching transistor 410 are controlled through the trigger 130 to be switched on and switched off. Therefore, the problem of power-off afterimage under a GOA architecture can be resolved, quality of a product can be improved, and competitiveness of the product is further improved.

A working process of the present disclosure is as follows.

The second switching circuit 400 uses an N-channel MOS transistor. When a control signal received by a gate of the N-channel MOS transistor is a high level, the N-channel MOS transistor is switched on. When the control signal received by the gate of the N-channel MOS transistor is a low level, the N-channel MOS transistor is switched off. The first switching circuit 300 uses a P-channel MOS transistor. When a control signal received by a gate of the P-channel MOS transistor is a low level, the P-channel MOS transistor is switched on. When the control signal received by the gate of the P-channel MOS transistor is a high level, the P-channel MOS transistor is switched off. The trigger circuit 100 uses a falling edge D trigger. When a pulse signal input end of the falling edge D trigger receives a falling edge signal, a logic level of a D input end of the falling edge D trigger is assigned to a Q output end.

During normal work, a constant direct current voltage (that is, the first voltage 120, usually 12V) is input through the pulse signal input end of the falling edge D trigger. Under an action of the first resistor 220, the control signals received by the gates of the N-channel MOS transistor, and the P-channel MOS transistor are both low levels (usually −6V). In this case, the P-channel MOS transistor is switched on, and the N-channel MOS transistor is switched off. The Q end of the falling edge D trigger has no output, and in this case, an output voltage of the drive chip 310 is equal to an input voltage of the display panel 320.

When a system is powered off, an external input voltage (that is, the first voltage 120) drops. When the pulse signal input end of the falling edge D trigger receives a falling edge of the first voltage 120, the falling edge D trigger assigns the logic level (that is, the preset voltage 110) of the D input end of the falling edge D trigger to the Q output end. In this case, the Q output end of the falling edge D trigger outputs a high level (that is, the control signals received by the gates of the N-channel MOS transistor, and the P-channel MOS transistor are both high levels, usually 33V), the N-channel MOS transistor is switched on, and the P-channel MOS transistor is switched off. In this case, the input voltage of the display panel 320 is equal to the preset voltage 110. That is, all the TFTs in the display panel 320 are turned on to neutralize charges in pixel electrodes to avoid power-off afterimage caused by residual charges after power-off.

From the above, the trigger circuit 100, the current limiting circuit 200, the first switching circuit 300 and the second switching circuit 400 are matched, and the first switching circuit 300 and the second switching circuit 400 are controlled through the trigger circuit 100 to be switched on and switched off, so that the problem of power-off afterimage under a GOA architecture can be resolved, quality of a product can be improved, and competitiveness of the product is further improved.

Figure 4:
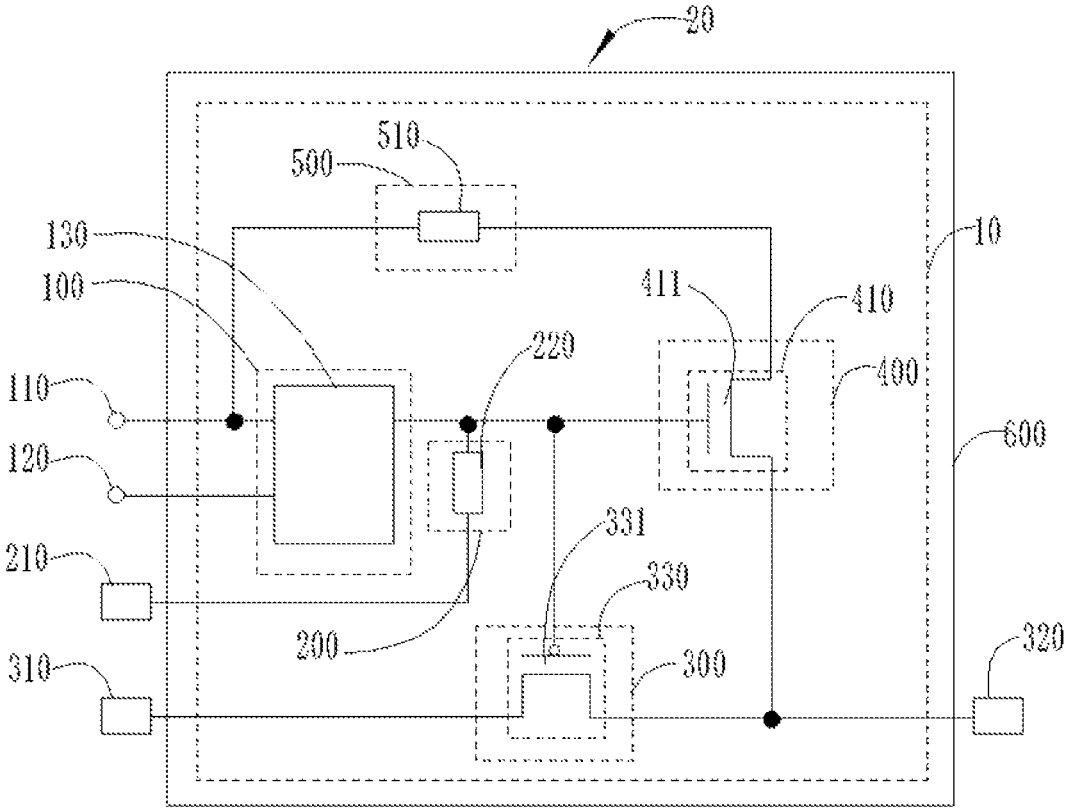
FIG. 4 is a block diagram of a display device according to an embodiment of the present disclosure.

Referring to FIG. 4, an embodiment of the present disclosure provides a display device 20, including a display panel 320 and the drive circuit 10 of any foregoing embodiment.

In an embodiment, the drive circuit 20 further includes a housing 600. The drive circuit 10 is arranged in the housing 600. It can be understood that a material for the housing 600 is not limited as long as a shape is ensured. In an embodiment, the material for the housing 600 is insulating rubber. In an embodiment, the material for the housing 600 is insulating glass. A specific material for the housing 600 may be selected according to a practical requirement.

Finally, it should be noted that the relational terms herein such as first and second are used only to differentiate an entity or operation from another entity or operation, and do not require or imply any actual relationship or sequence between these entities or operations. Moreover, the terms "include", "comprise", and any variants thereof are intended to cover a non-exclusive inclusion. Therefore, in the context of a process, method, object, or device that includes a series of elements, the process, method, object, or device not only includes such elements, but also includes other elements not specified expressly, or may include inherent elements of the process, method, object, or device. Without further limitation, the element defined by a phrase "include one . . . " does not exclude other same elements in the process, method, article or device which include the element.

It should be noted that the embodiments in this specification are all described in a progressive manner. Description of each of the embodiments focuses on differences from other embodiments, and reference may be made to each other for the same or similar parts among respective embodiments.

The above description of the disclosed embodiments enables a person skilled in the art to implement or use the present disclosure. Various modifications to these embodiments are obvious to a person skilled in the art, the general principles defined herein may be implemented in other embodiments without departing from the spirit and scope of the present disclosure. Therefore, the present disclosure is not limited to these embodiments illustrated herein but needs to conform to the broadest scope consistent with the principles and novel features disclosed herein.

What is claimed is:

1. A drive circuit for a display panel, comprising:

a trigger circuit, wherein a preset voltage is input through a first input end of the trigger circuit, and a first voltage is input through a second input end of the trigger circuit;

a current limiting circuit, wherein an input end of the current limiting circuit is electrically coupled to an output end of a power supply;

a first switching circuit, wherein a first input end of the first switching circuit is electrically coupled to an output end of the trigger circuit and to an output end of the current limiting circuit; a second input end of the first switching circuit is electrically coupled to an output end of a drive chip, and an output end of the first switching circuit is electrically coupled to the display panel; and a second switching circuit, wherein a first input end of the second switching circuit is electrically coupled to the output end of the trigger circuit and to the output end of the current limiting circuit; a second input end of the second switching circuit is electrically coupled to the first input end of the trigger circuit, and an output end of the second switching circuit is electrically coupled to the display panel;

wherein when the first switching circuit is switched on, the second switching circuit is switched off, and when the second switching circuit is switched on, the first switching circuit is switched off.

2. The drive circuit for the display panel according to claim 1, the trigger circuit comprising a trigger, wherein the first voltage is input through a pulse input end of the trigger, the preset voltage is input through a D input end of the trigger, and a Q output end of the trigger is electrically coupled to the first input end of the first switching circuit and to the first input end of the second switching circuit.

3. The drive circuit for the display panel according to claim 1, the current limiting circuit comprising a first resistor, wherein one end of the first resistor is electrically coupled to the output end of the power supply, and the other end of the first resistor is electrically coupled to the first input end of the first switching circuit and to the first input end of the second switching circuit.

4. The drive circuit for the display panel according to claim 1, the first switching circuit comprising a first switching transistor, wherein a gate of the first switching transistor is electrically coupled to the output end of the trigger circuit and to the output end of the current limiting circuit; a source of the first switching transistor is electrically coupled to the output end of the drive chip, and a drain of the first switching transistor is electrically coupled to the display panel.

5. The drive circuit for the display panel according to claim 1, the first switching circuit comprising a first switching transistor, wherein a gate of the first switching transistor is electrically coupled to the output end of the trigger circuit and to the output end of the current limiting circuit; a source of the first switching transistor is electrically coupled to the display panel, and a drain of the first switching transistor is electrically coupled to the output end of the drive chip.

6. The drive circuit for the display panel according to claim 5, wherein the first switching transistor is a first field effect transistor.

7. The drive circuit for the display panel according to claim 1, the second switching circuit comprising a second switching transistor, wherein a gate of the second switching transistor is electrically coupled to the output end of the trigger circuit and to the output end of the current limiting circuit; a source of the second switching transistor is electrically coupled to the first input end of the trigger circuit, and a drain of the second switching transistor is electrically coupled to the display panel.

8. The drive circuit for the display panel according to claim 1, the second switching circuit comprising a second switching transistor, wherein a gate of the second switching transistor is electrically coupled to the output end of the trigger circuit and to the output end of the current limiting circuit; a source of the second switching transistor is electrically coupled to the display panel, and a drain of the second switching transistor is electrically coupled to the first input end of the trigger circuit.

9. The drive circuit for the display panel according to claim 8, wherein the second switching transistor is a second field effect transistor.

10. The drive circuit for the display panel according to claim 1, further comprising a step-down circuit electrically coupled between the first input end of the trigger circuit and the first input end of the second switching circuit.

11. The drive circuit for the display panel according to claim 10, the step-down circuit comprising a second resistor, wherein one end of the second resistor is electrically coupled to the first input end of the trigger circuit, and the other end of the second resistor is electrically coupled to the first input end of the second switching circuit.

12. A drive circuit for a display panel, comprising:

a trigger, wherein a preset voltage is input through a first input end of the trigger, and a first voltage is input through a second input end of the trigger;

a current limiting circuit, wherein an input end of the current limiting circuit is electrically coupled to an output end of a power supply;

a first switching transistor, wherein a first input end of the first switching transistor is electrically coupled to an output end of the trigger and to an output end of the current limiting circuit; a second input end of the first switching transistor is electrically coupled to an output end of a drive chip, and an output end of the first switching transistor is electrically coupled to the display panel; and a second switching transistor, wherein a first input end of the second switching transistor is electrically coupled to the output end of the trigger and to the output end of the current limiting circuit; a second input end of the second switching transistor is electrically coupled to the first input end of the trigger, and an output end of the second switching transistor is electrically coupled to the display panel;

wherein when the first switching transistor is switched on, the second switching transistor is switched off, and when the second switching transistor is switched on, the first switching transistor is switched off.

13. The drive circuit for the display panel according to claim 12, the current limiting circuit comprising a first resistor, wherein one end of the first resistor is electrically coupled to the output end of the power supply, and the other end of the first resistor is electrically coupled to the first input end of the first switching transistor and to the first input end of the second switching transistor.

14. The drive circuit for the display panel according to claim 12, further comprising a step-down circuit electrically coupled between the first input end of the trigger and the first input end of the second switching transistor.

15. The drive circuit for the display panel according to claim 14, the step-down circuit comprising a second resistor, wherein one end of the second resistor is electrically coupled to the first input end of the trigger, and the other end of the second resistor is electrically coupled to the first input end of the second switching transistor.

16. The drive circuit for the display panel according to claim 12, wherein the first input end of the first switching transistor is a gate of the first switching transistor, the second input end of the first switching transistor is a source of the first switching transistor, and the output end of the first switching transistor is a drain of the first switching transistor.

17. The drive circuit for the display panel according to claim 16, wherein the first switching transistor is a first field effect transistor.

18. The drive circuit for the display panel according to claim 12, wherein the first input end of the second switching transistor is a gate of the second switching transistor, the second input end of the second switching transistor is a source of the second switching transistor, and the output end of the second switching transistor is a drain of the second switching transistor.

19. The A display device, comprising a display panel and a drive circuit for the display panel, wherein the drive circuit for the display panel comprises:

a trigger circuit, wherein a preset voltage is input through a first input end of the trigger circuit, and a first voltage is input through a second input end of the trigger circuit;

a current limiting circuit, wherein an input end of the current limiting circuit is electrically coupled to an output end of a power supply;

a first switching circuit, wherein a first input end of the first switching circuit is electrically coupled to an output end of the trigger circuit and to an output end of the current limiting circuit; a second input end of the first switching circuit is electrically coupled to an output end of a drive chip, and an output end of the first switching circuit is electrically coupled to the display panel; and a second switching circuit, wherein a first input end of the second switching circuit is electrically coupled to the output end of the trigger circuit and the output end of the current limiting circuit, respectively; a second input end of the second switching circuit is electrically coupled to the first input end of the trigger circuit, and an output end of the second switching circuit is electrically coupled to the display panel;

wherein when the first switching circuit is switched on, the second switching circuit is switched off, and when the second switching circuit is switched on, the first switching circuit is switched off.

20. The display device according to claim 19, further comprising a housing, wherein the display panel and the drive circuit for the display panel are arranged in the housing.

* * * * *